US007527095B2

(12) United States Patent
Bloess et al.

(10) Patent No.: US 7,527,095 B2
(45) Date of Patent: May 5, 2009

(54) METHOD OF CREATING A ZONAL ISOLATION IN AN UNDERGROUND WELLBORE

(75) Inventors: Andreas Bloess, Waldorf (DE); Martin Gerard Rene Bosma, Rijswijk (NL); Erik Kerst Cornelissen, Rijswijk (NL); Michael Caspar Gunningham, Rijswijk (NL); Cornelis Jan Kenter, Rijswijk (NL); Robert Nicholas Worrall, Rijswijk (NL)

(73) Assignee: Shell Oil Company, Houston, TX (US)

( * ) Notice: Subject to any disclaimer, the term of this patent is extended or adjusted under 35 U.S.C. 154(b) by 450 days.

(21) Appl. No.: 11/008,334

(22) Filed: Dec. 9, 2004

(65) Prior Publication Data

US 2006/0124304 A1 Jun. 15, 2006

(30) Foreign Application Priority Data

Dec. 11, 2003 (EP) ..... 03257795

(51) Int. Cl.
*E21B 33/00* (2006.01)
*E21B 43/26* (2006.01)

(52) U.S. Cl. ..... 166/265; 166/285; 166/228

(58) Field of Classification Search ..... 166/265, 166/285, 228, 207, 277
See application file for complete search history.

(56) References Cited

U.S. PATENT DOCUMENTS

| | | | | |
|---|---|---|---|---|
| 1,979,802 A | | 11/1934 | Kinley | 102/11 |
| 2,092,041 A | | 9/1937 | Armentrout et al. | 166/1 |
| 2,460,561 A | | 2/1949 | Winkleman | 166/1 |
| 3,134,440 A | | 5/1964 | Nelson | 166/114 |
| 3,463,230 A | * | 8/1969 | Dodson | 166/250.02 |
| 3,623,550 A | | 11/1971 | Guy de Lajarte et al. | 166/125 |
| 3,866,681 A | | 2/1975 | Shirley | 166/285 |
| 4,423,783 A | | 1/1984 | Haag | 166/382 |
| 5,295,542 A | * | 3/1994 | Cole et al. | 166/278 |
| 5,623,993 A | * | 4/1997 | Van Buskirk et al. | 166/292 |
| 6,659,179 B2 | * | 12/2003 | Nguyen | 166/227 |
| 2005/0022991 A1 | * | 2/2005 | Rao | 166/280.2 |

FOREIGN PATENT DOCUMENTS

| | | |
|---|---|---|
| GB | 2269840 | 2/1994 |
| WO | 94/03703 | 2/1994 |

* cited by examiner

*Primary Examiner*—David J Bagnell
*Assistant Examiner*—Nicole Coy

(57) ABSTRACT

A method of creating a zonal isolation above a target zone in an underground wellbore comprises:

inserting a slurry injection tubing into the wellbore;

arranging within an annular space surrounding said tubing an particle accumulation means, such as an expandable screen or an area where the slurry velocity is reduced; and pumping a slurry comprising a carrier fluid and granular material down via the slurry injection tubing and the target zone and then up into the annular space, such that at least some granular material accumulates and forms an elongate zonal isolation in the annular space between the target zone and the particle accumulation means, which zonal isolation is removable and exerts a limited radial force to the surrounding formation, thereby reducing the risk of formation damage.

35 Claims, 14 Drawing Sheets

METHOD OF CREATING A ZONAL ISOLATION IN AN UNDERGROUND WELLBORE

FIELD OF INVENTION

The invention relates to a method of creating a zonal isolation in an underground wellbore.

BACKGROUND OF THE INVENTION

It is common practice to create a zonal isolation in an underground wellbore by inserting an inflatable elastomeric plug or packer in the wellbore.

If the wellbore is an uncased section of an underground borehole then the expanded plug or packer may exert a high radial force on the surrounding underground formation, thereby lowering the compressive hoop stresses in the formation such that fractures may be initiated in the formation adjacent to the plug or packer.

It is known from U.S. Pat. No. 5,623,993 to insert an expandable packer in a wellbore such that the impact on the compressive hoop stresses in the surrounding formation is limited. The packer is equipped with a water drainage conduit and granular material is deposited on top of the packer so that water will drain down through the matrix of granular material, thereby enhancing the packing density thereof. If subsequently a treatment and/or fracturing fluid is injected into the formation surrounding the borehole section above the packer, then the compacted plug of granular material transfers at least part of the axial load, which is due to the pressure differential over the pack to the inner surface of the wellbore along the interval packed with granules and thereby distributes the related radial force over a longer distance along a longitudinal axis of the wellbore, so that the risk of fracturing of the formation surrounding the inflated packer and adjacent compacted plug of granular material is inhibited.

The inflatable packer known from this prior art reference is only suitable for use in a wellbore region below the target section into which fluid is to be injected into the formation and is not suitable for use in irregularly shaped wellbores, such as an elliptically shaped borehole or a borehole with washouts, or for use in high temperature regions, such as in geothermal wells, since conventional inflatable packers comprise elastomeric materials that disintegrate at high temperatures.

U.S. Pat. Nos. 3,134,440; 3,623,550 and 4,423,783 disclose expandable well packers which comprise an umbrella-shaped frame which is expanded downhole to provide a barrier on top of which granular material, such as marbles, pea gravel and/or cement, is deposited to provide a fluid tight seal in the well. The known umbrella-shaped frame can conform to an irregular or unround wellbore to a limited extent, but is not configured to compact the granular material, so that the plug is only loosely set and may not penetrate into washouts and/or fractures in the surrounding formation.

U.S. Pat. No. 3,866,681 discloses a well packer wherein a granular packer is created on top of a doughnut device which is arranged around a slurry injection tubing and which comprises slurry transport channels with one way check valves such that a slurry can be injected down through the tubing and then up through the doughnut device into the annulus above the device where an annular matrix of granular material is induced to settle above the doughnut device.

Each of the known zonal isolations systems is configured to set a granular plug on top of an expandable barrier so that they can only be used to isolate a wellbore section below a target section.

It is an object of the present invention to provide a method for zonal isolation in a wellbore, which can be used to provide a zonal isolation between a target section and a wellbore section between a target section and a wellhead.

It is a further object of the present invention to provide a method for zonal isolation in a wellbore which is suitable for use in irregularly shaped wellbores and/or at high temperatures and which only exerts a limited radial force per unit length on the formation surrounding the wellbore, the risk of formation fracturing or weakening adjacent to the zonal isolation region.

It is a further object of the present invention to provide a method for zonal isolation between a target zone and a wellhead such that the length of the granular zonal isolation plug zone can be selected such that an elongate plug can be placed and the pressure differential can be distributed over a long longitudinal interval of the wellbore such that the risk of fluid bypassing via the formation surrounding the plug is reduced and that the pressure gradient profile along the length of the plug can be adjusted to the strength and other physical properties of the formation surrounding the plug.

It is a further objective of the present invention to provide a method for creating a zonal isolation, which can be easily removed or replaced to carry out a sequence of stimulation, fracturing or injection operations at different sections within a given well.

SUMMARY OF THE INVENTION

In accordance with the invention there is provided a method of creating a zonal isolation adjacent to a target zone in an underground wellbore, the method comprising:

- inserting a slurry injection tubing through a wellhead into the wellbore;
- arranging a particle accumulation means in an annular space surrounding the slurry injection tubing at a location between the target zone and the wellhead; and
- pumping a slurry comprising a carrier fluid and granular material via the slurry injection tubing into the annular space, such that at least some granular material accumulates adjacent to the particle accumulation means and the accumulated granular material forms a zonal isolation comprising packed granular material adjacent to the particle accumulation means.

An advantage of providing a zonal isolation in this way, rather than using an inflatable packer, is that only a minimum pressure is exerted by the isolation on the formation at the position of the isolation. With inflatable packers, the inflation pressure causes high local stress. When a lower target zone is to be fractured by applying high pressure, it can thus happen that undesirable fracturing occurs adjacent to the location of the packer, which means that the packer does not form an effective seal anymore.

In the method of the invention the granular material can be induced to accumulate in a region of the annular space which is located between the target zone and the particle accumulation means, such that the particle accumulation means is arranged between the accumulated granular material and the wellhead. It is also possible to induce accumulation substantially at the location of the particle accumulation means, which is between the target zone and the wellhead.

The particle accumulation means is arranged at a selected location in the wellbore, and which is fixed with respect to the injection tube during injection of the slurry.

The wellbore may have a vertical, inclined, horizontal or J-shaped configuration and the target zone may be located near a lower end of the wellbore. In such case the particle accumulation means is arranged in a section of the wellbore, which is located between the target zone and the wellhead.

If the wellbore has a substantially vertical or inclined orientation, then the particle accumulation means is located above the matrix of accumulated granular material and above the target zone, and in such case it is preferred that the granular material comprises granules having a density which is substantially equal to or lower than the density of the fluid.

Generally speaking, the particle accumulation means is arranged to modify the flow of the slurry in the annulus such that particles are accumulated. This can be achieved in various ways. A particular aspect of the particle accumulation means is that the granules from the slurry are concentrated, i.e. the liquid content of the slurry is lowered. To this end the particle accumulation means suitably comprises a means for removing liquid from the slurry, in particular a means selected from the group consisting of a fluid permeable barrier in the annular space, and a fluid return conduit surrounding the slurry injection tubing. During pumping of the slurry at least part of the carrier fluid is removed from the slurry in this way, preferably at least 50% of the carrier fluid.

The particle accumulation means may comprise an expandable screen assembly, which is permeable to the carrier fluid, but impermeable to at least some of the granular material. In such case the method suitably comprises:

radially expanding the screen assembly within the annular space; and inducing the fluid slurry to flow in longitudinal direction through the annular space such that at least some carrier fluid is induced to flow through the expanded screen assembly and at least some granular material is induced to settle and accumulate against the expanded screen assembly, thereby forming a zonal isolation comprising a matrix of packed granular material in the annular space between the target zone and the expanded screen assembly.

Preferably, the expandable screen assembly comprises a radially expandable carrier frame to which a permeable barrier layer, such as woven metallic or textile fibers, or a permeable membrane, is attached. The barrier layer may be formed and/or enhanced in situ by pumping assemblages of metal wool, glass wool, woven material or the like along the annulus and inducing it to settle against an expanded screen assembly or expanded carrier frame. The carrier frame may comprise spring blades that are arranged at short circumferential intervals at the outer surface of the slurry injection tubing, which expand possibly independently from each other against the borehole wall.

The radially expandable carrier frame suitably comprises an expandable umbrella-shaped frame, which comprises at least three arms that are each at one end pivotally connected to the outer surface of the slurry injection tubing such that another portion of each arm is induced to swing against the inner surface of the wellbore or well casing in response to expansion of the umbrella-shaped frame.

The expandable carrier frame further suitably comprises a bow-spring centralizer assembly having at least three centralizer blades, which expand against the borehole wall at circumferentially spaced locations.

Suitably, at least one centralizer blade is configured to expand against the inner surface of the surrounding wellbore or well casing independently from other centralizer blades, such that the blades each expand against said inner surface even if the surface has an irregular, unround or elliptical inner shape.

Suitably, the assembly of bow spring centralizer blades comprises a set of short and a set of long centralizer blades, that are each at one end thereof secured to a first end ring which is secured to the outer wall of the fluid injection tubing and wherein the ends of the short centraliser blades are secured to a second end ring which is slidably arranged around the fluid injection tubing and the ends of the long centralizer blades are secured to a third end ring which is slidably arranged around the outer wall of the fluid injection tubing.

Alternatively, the assembly of bow spring centralizer blades can comprise a set of short and a set of long centralizer blades and the ends of the long centralizer blades are secured to end rings which are slidably arranged around the fluid injection tubing at different sides of a stop collar which is secured to the outer surface of the tubing, and wherein the ends of the short centralizer blades are secured to end rings which are slidably arranged around the fluid injection tubing and which are each located between the stop collar and one of the end rings of the long centralizer blades.

The expandable screen assembly can comprise a woven pattern of helically coiled fibers, which fibers are secured between a pair of rings that are arranged around the outer surface of the fluid injection tubing and which are moved towards each other such that the helically coiled fibers deform and are at least partly expanded against the inner surface of the wellbore.

Also, the expandable screen assembly can comprise a permeable sack, which is filled with granular material, and which is induced to expand against the inner surface of the wellbore in response to flux of the fluid slurry flowing up through the annular space between the slurry injection tubing and the wellbore.

The ends of the centralizer blades can be connected at axially spaced locations to the outer surface of a radially expandable slurry injection tubing, such that the centralizer blades are arranged in a substantially stretched position around the tubing before expansion of the tubing and that the distance between the ends of the stabilizer blades is decreased as a result of the axial shortening of the tubing during the expansion process, whereby the centralizer blades are induced to radially expand within the annulus surrounding the fluid injection tubing.

The granular material can be any kind of solid, and the grain size can be chosen between few micron, e.g. 5, 10 or 50 micron and several millimeters, up to about one fifth of the radial width of the annulus.

The fluid slurry may comprise fibrous material, such as chopped straight or curled fibers, assemblages of metal wool, glass fiber mats or other pumpable proppant material which is induced to settle against the expanded screen assembly or carrier frame prior to or simultaneously with the granular material.

The fluid slurry may comprise an aqueous cement slurry which dewaters and is induced to set against the expanded screen assembly.

The granular material carried by the slurry may comprise a swellable rubber, resin coated gravel, sand, such as Ottawa sand, a natural or artificial proppant, glass, plastic or other beads, hollow beads, beads and/or balls that are coated with glue, resin or fibers, steel or magnetisable metals, fibers, and/or fibers with hooks.

The particle accumulation means may be provided with magnets and the granular material may comprise magnetisable components, such as ferromagnetic particles.

The granular material may furthermore comprise a material and/or coating which dissolves at an elevated temperature or in a specific fluid, such as an acidic or caustic fluid. An example of such granular material is calcium carbonate.

The particle accumulation means may also be provided by a region of the annular space, in which the fluid velocity is reduced and granular material is induced to settle. At a given fluid flow rate the fluid velocity is lowered at a higher cross-section of the annular space.

The region of the annular space, in which the fluid velocity is reduced may be provided by a pipe section, wherein the outer diameter of the pipe is reduced. The region of the annular space in which the fluid velocity is reduced may be formed by a washout zone in which the wellbore has a larger width than other parts of the wellbore.

The region of the annular space in which the fluid velocity is reduced may also be formed by an area where the fluid injection tubing is surrounded by a fluid return conduit which has a permeable outer wall, and at least some fluid is induced to flow from the annular space into the fluid return conduit.

Suitably, the slurry injection tubing is double-walled within the section between the particle accumulation means and the target zone with an outer wall which is permeable to the carrier fluid but impermeable to the granulate material, such that at least some carrier fluid seeps into the double-walled pipe to reduce the flow rate along the annulus at a constant pump rate and is re-injected via the slurry-injection conduit into the target zone or released into the annular space above the particle accumulation means.

The slurry injection tubing may be tapered in the region between the expandable screen assembly and the target zone, such that the velocity of the slurry in the annular space is reduced when the slurry flows from the target zone towards the screen assembly.

After installation of the matrix of granular material in the annulus surrounding the slurry injection tubing, a fracturing, stimulation, treatment, formation etching, disposed or other fluid may be injected via the slurry injection tubing into the formation surrounding the target zone.

Preferably, the matrix of packed granular material is configured such it has a higher longitudinal permeability than at least a substantial part of the formation surrounding the target section of the wellbore.

The slurry injection tubing may comprise a pair of axially spaced expandable screen assemblies and may be inserted into the wellbore such that the target zone is located between said assemblies whereupon slurry is injected via an outlet opening in the wall of the tubing into the region of the annular space between the screen assemblies such that at least some granular material accumulates against the screen assemblies and a zonal isolation is created at both sides of the target zone.

In a particular embodiment the slurry injection tubing is radially expanded after inserting a matrix of packed granular material in the annulus between the slurry injection tubing and the wellbore, thereby increasing the packing density and decreasing the permeability of the matrix of packed granular material.

It is possible to arrange a skirt shaped barrier layer is around the slurry injection tubing and secured to an upper section of the centralizer blades such that the skirt shaped barrier layer substantially spans the width of the annular space in response to expansion of the centralizer blades.

The fluid slurry can comprises granular material of which the grain size is stepwise or gradually reduced during the injection process thereby inducing an initial batch of coarse granular material to settle and accumulate and subsequent batches of less coarse granular material to settle and accumulate against the annular matrix of coarser granular material.

In a particular embodiment, before pumping of the slurry into the annular space an auxiliary material can be arranged in the annular space, forming a fluid permeable barrier. Suitably the auxiliary material comprises a solid foam, preferably a flexible solid foam, more preferably a flexible solid open-cell foam, such as polyurethane.

In an important class of applications of the method, the packed granular material forms a physical accumulation, in particular without formation of chemical bonds and/or without swelling of the granular material.

In other applications, the fluid slurry can comprise a cement and/or swellable clay (bentonite) slurry from which the carrier fluid is removed during accumulation. In particular the carrier fluid can be selected such that cement does not set and/or the bentonite does not swell in the carrier fluid, and wherein after accumulation of cement particles in the annular space a setting fluid and/or swelling fluid, preferably comprising water, is passed through the accumulated particles thereby allowing the cement to set and/or bentonite to swell.

The outer surface of the slurry injection tubing can be provided with a helical ridge and after completion of the fluid injection into the formation via the target zone the slurry injection tubing can be rotated such that the helical ridge induces the tubing to move upwardly through the matrix of granular material towards the wellhead.

The wellbore may form part of an oil and/or gas production well, a geothermal well, a water well and/or a disposal well.

The slurry injection tubing can be provided by a drill string and the particle accumulation means can be provided by a centraliser assembly near a lower end of the drill string, and the method then can comprise the steps of:

- injecting a slurry through the drill string and drill bit into the surrounding annulus to form a removable matrix of packed granular material in the annulus in a region between the centralizer assembly and the drill bit,
- injecting a treating, formation stabilizing and/or other fluid into the formation in the region between the bottom of the wellbore and the matrix of packed granular material,
- removing the matrix of granular material from the annulus, and
- inducing the drill bit to drill a further section of the wellbore or pulling the drillstring and drill bit out of the wellbore.

The carrier fluid is preferably a liquid, and can be a foam or an emulsion.

These and several other embodiments of the method according to the invention are described in the accompanying claims, abstract and the following detailed description of preferred embodiments in which reference is made to the accompanying drawings.

BRIEF DESCRIPTION OF THE DRAWINGS

The invention will be described in more detail with reference to the accompanying drawings, in which.

DETAILED DESCRIPTION OF THE INVENTION

Figure 1:
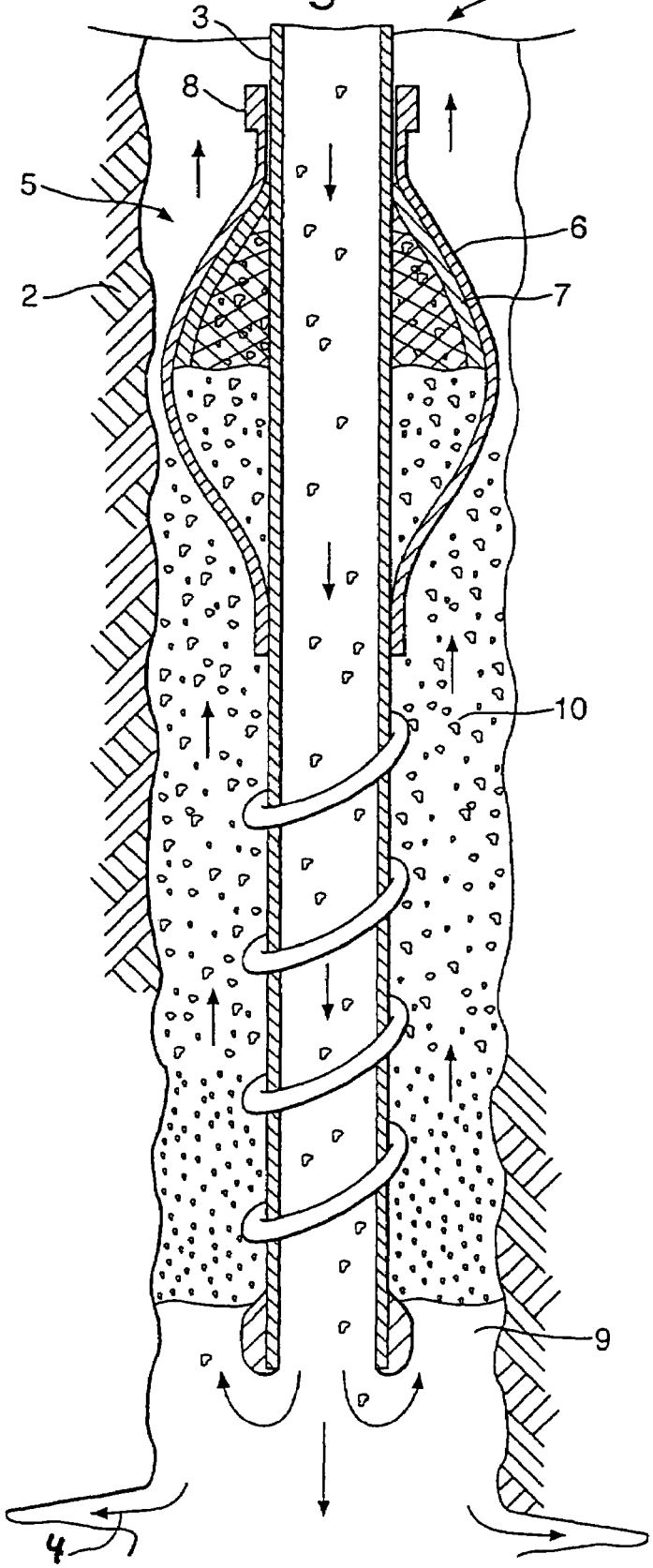
FIG. 1 is a longitudinal sectional view of a wellbore in which a zonal isolation is created by means of the method according to the present invention.

FIG. 1 depicts a wellbore 1 which traverses an underground earth formation 2. The wellbore 1 may e.g. be used for transport of crude oil and/or natural gas to surface, for circulation of water through fractures in a hot formation for generation of steam and recovery of geothermal energy, for waste injection, for gas storage, and/or as an observation well.

A slurry injection tubing 3 is suspended from a wellhead at surface (not shown) in the wellbore 1 above a target zone 4 of the wellbore 1, from which target zone the formation 2 is to be fractured or stimulated or where a treatment, etching or disposed fluid is to be injected into the formation 2.

A particle accumulation means in the form of an expandable screen assembly 5 is arranged around the slurry injection tubing 3, which assembly comprises an expandable bow-spring centralizer assembly 6 to which a permeable barrier layer 7 is attached. The lower ends of the bow spring centralizers 6 are connected to the outer surface of the tubing 3 and the upper ends of the bow spring centralizers 6 are connected to an end ring 8, which is slidably arranged around the tubing 3.

According to the method of the present invention, a slurry of aqueous carrier fluid and granular material is injected down through slurry injection tubing 3 via the target zone 4 up into the annular space 9 between the slurry injection tubing 3 and the inner surface of the wellbore 1. Spring forces and/or drag forces exerted by the slurry induce the bow-spring centralizer assembly 6 to expand against the inner surface of wellbore 1, whereupon the carrier fluid continues to flow through the permeable barrier layer 7, but at least part of the granular material is blocked by the barrier layer 7 and accumulates into a compacted annular plug 10 of granular material.

The granular material preferably has a density, which is about equal or lower than the density of the carrier fluid, so that the granular material floats up and the plug remains intact when circulation of carrier fluid is interrupted. Alternatively fluid is pumped continuously via the tubing 3 and the target zone 4 up into the annulus 9, such that fluid velocity in the annulus 9 is above the slip velocity of the granular material, to permanently compress the annular plug 10 until the fluid injection and/or fracturing operations in the formation 2 adjacent the target zone 4 have been completed. The granulate pack may consist of granules, which reduce in sizes towards the bottom of the annular plug 10, such that the pressure gradient increases downwardly along the plug 10 so that a) the load on the expandable screen assembly is reduced for a given pressure differential over the entire pack b) the pressure isolation, or in other words, the longitudinal pressure difference per unit of length is most effective near the bottom of the plug 10.

Figure 2:
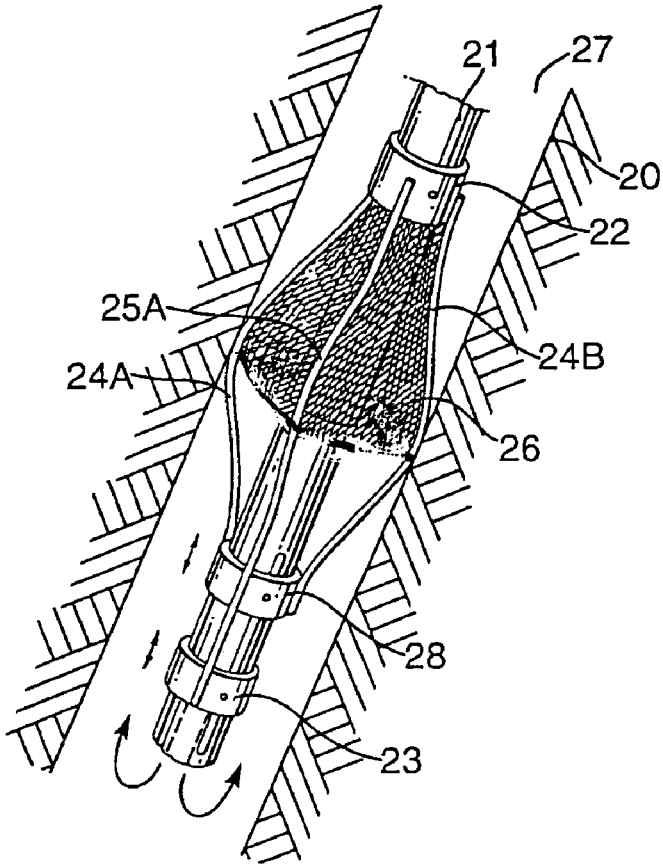
FIG. 2 is a side view of an expandable screen assembly for use in the method according to the invention.

FIG. 2 shows an inclined underground wellbore 20 in which a slurry-injection tubing 21 is suspended. The tubing 21 carries an external expandable screen assembly, which comprises an upper end ring 22, which is secured to the tubing 21 and two lower end rings 23 and 28, which are slidably arranged around the tubing 21. A first set of two short bow-spring stabilizer blades 24A and 24B is secured at diagonally opposite locations between the upper end ring 22 and the first lower ring 28 and a second set of two long bow-spring stabilizer blades 25A and 25B (see FIG. 3) is secured at diagonally opposite locations between the upper end ring 22 and the second lower ring 23. A permeable skirt 26 is secured to the upper end ring 22 and the upper halves of the stabilizer blades 24A-B and 25A-B such that the skirt will open up as a parachute and expand against the inner surface of the wellbore 20 in response to the expansion of the centralizer blades and/or an upward flow of fluid through the annular space 27 between the tubing 21 and wellbore 10.

Figure 3:
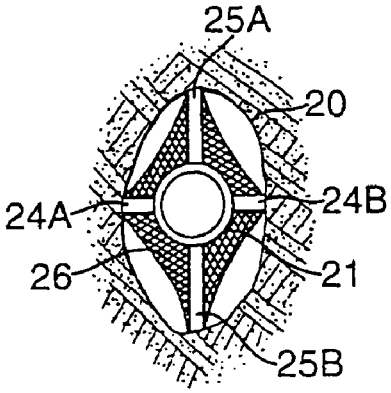
FIG. 3 is a cross-sectional view of the screen assembly shown in FIG. 2, when expanded in an elliptically shaped borehole.

FIG. 3 shows a cross-sectional view of the assembly shown in FIG. 2 within an elliptically shaped wellbore 20. Since the first set of bow-spring stabilizer blades 24A and B expands independently from the second set of bow-spring stabilizer blades 25A and B, the second set of blades 25A and B is permitted to a larger diameter than the first set of blades 24A and B, so that each of the blades 24 and 25 A and B is expanded against the elliptical inner surface of the wellbore 20. The parachuting effect of the upward fluid stream through the annulus 27 will cause the skirt to open up as a parachute and expand against the elliptical inner surface of the wellbore 20.

Figure 4:
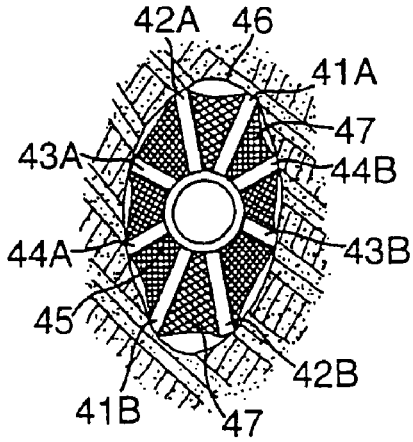
FIG. 4 depicts an expandable screen assembly comprising a set of eight bow spring stabilizer blades to which a permeable barrier layer is attached.

FIG. 4 shows a cross-sectional view of an assembly where four sets of diagonally opposite bow-spring stabilizer blades 41A-B, 42A-B, 43A-B and 44A-B are secured between an upper end ring and a set of four lower end rings that are slidably secured around a slurry injection tubing 45 and an elliptical wellbore 46 such that the blades are all expanded against the elliptical inner surface of the wellbore 46. A permeable skirt 47 is secured to the upper sections of the blades such that the skirt 47 will open up as a parachute and expand against the elliptical inner surface of the wellbore 46 in response to upward flow of fluid through the annular space between the tubing 45 and inner surface of the wellbore 46. The permeable skirt 47 preferably has a lower density than the carrier fluid of the slurry to enhance the parachuting effect.

Figure 5:
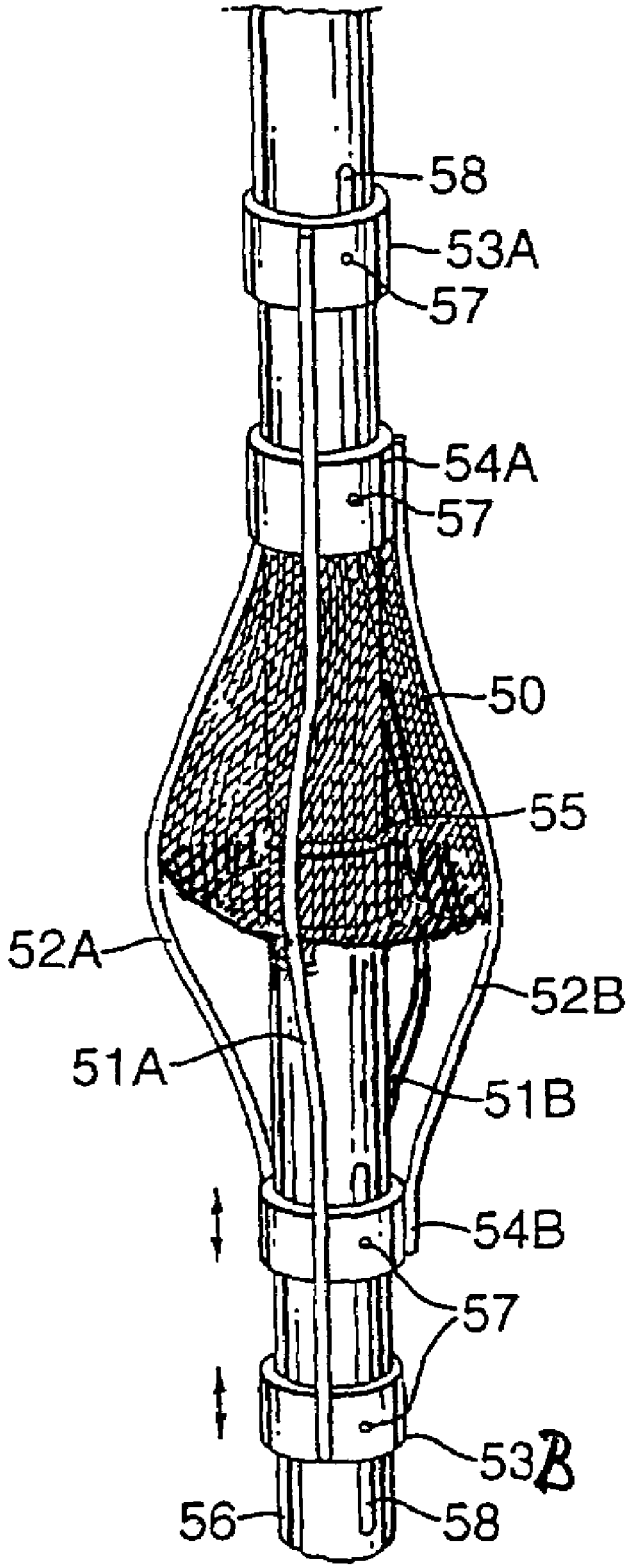
FIG. 5 depicts a three-dimensional view of an expandable screen assembly comprising a pair of long and a pair of short centralizer blades.

FIG. 5 shows an expandable screen 50 which is mounted on an expandable carrier frame comprising a pair of long bow-spring centralizer blades 51A and B and a pair of long centralizer blades 52 A and B. The ends of the long blades 51 A and B are connected to a first pair of end rings 53 A and B and the ends of the short blades 52 A and B are connected to a second set of end rings 54 A and B. A stop collar 55 is secured to the outer wall of a slurry injection tubing 56 at a location between the upper end rings 53A and 54A and the lower end rings 53B and 54B. The end rings 53A-B and 54A-B are slidably arranged around the slurry injection tubing 56 such that during the descend of the slurry injection tubing 56 into a wellbore the lower end rings are pulled against the stop collar 55, and the stabilizer blades 51A-B and 52A-B are allowed to freely slide alongside the borehole wall even if the wellbore has an irregular shape. When the tubing 56 is pulled out of the wellbore the upper end rings are pulled against the stop collar 55 and the stabilizer blades are again permitted to freely slide alongside the borehole wall without the risk of stalling of a stabilizer blade if it passes a narrowing section of the wellbore. Thus, an advantage of the slidable centralizer assembly shown in FIG. 5 is that it can be lowered and raised in irregular boreholes without the risk of stalling of the assembly and that the short and long centralizer blades 51A-B and 52A-B expand the screen 50 uniformly against the borehole wall even if the borehole has an irregular or oval shape. The end rings 53A-B and 54 A-B may be provided with inwardly projecting pins 57 that slide within longitudinal grooves 58 in the outer wall of the tubing 56 to maintain the stabilizer blades 51A-B and 52A-B in fixed substantially equally distributed positions around the outer circumference of the tubing 56.

Figure 6A:
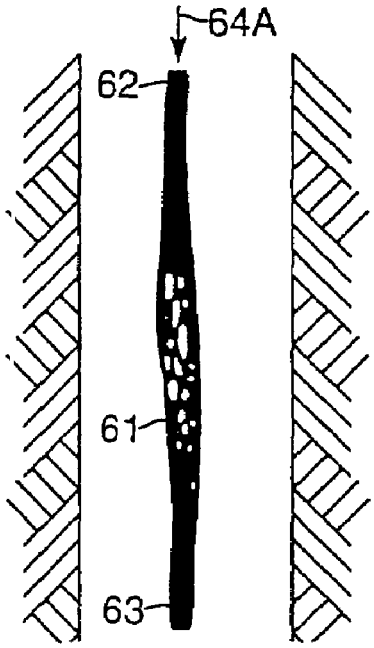
FIG. 6A-D depict an expandable screen assembly comprising a woven pattern of helical fibers which are expanded into an umbrella shaped configuration when the ends of the fibers are moved towards each other.
Figure 6B:
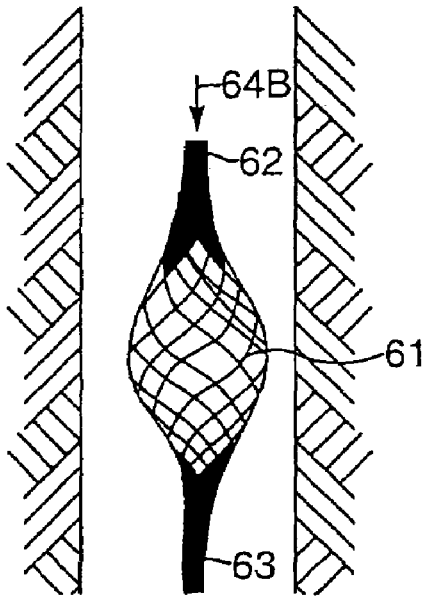
Figure 6C:
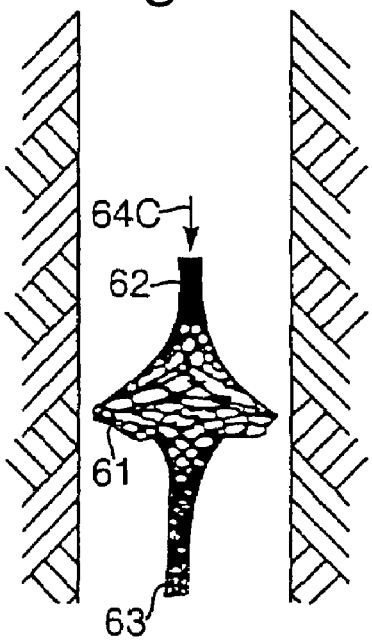
Figure 6D:
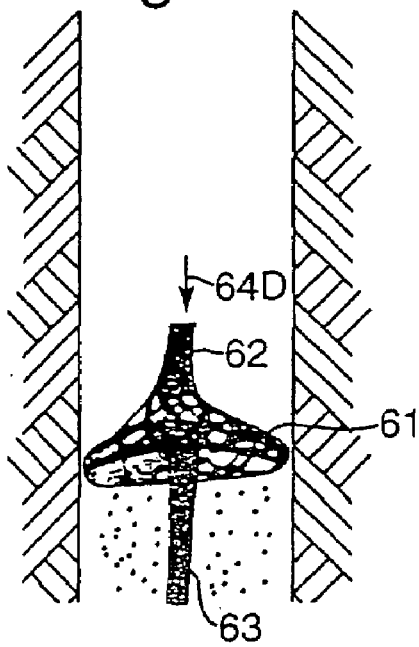

FIG. 6A-6D show an expandable flow restrictor made of a woven assembly of helical fibers 61. The fibers 61 are woven at opposite pitch angles and the material shown is known as green tweed or PEC. In FIG. 6A the fibers 61 are stretched and tightly surround the slurry injection tubing (not shown). FIG. 6B-D show successive shapes of the fiber assembly when the upper and lower ends 62 and 63 of the assembly are moved towards each other as indicated by the arrows 64A-D. FIG. 6D shows the final fully expanded shape obtained in the annulus where the granular packer is to be set. If a slurry comprising balls or patches of packed metallic fibers or felt is injected upwardly against the expanded fiber assembly a permeable barrier layer is formed against which a granular plug of sand or gravel particles can be set, so that only the carrier fluid seeps through the barrier layer and a compacted granular plug is sucked against the annular barrier layer.

In all cases, where a bow-spring centralizer assembly is used as an expandable carrier frame the expandable screen assembly may be run in an unfolded mode or in a folded mode, in the latter case the screen assembly being activated and expanded against the borehole wall by means of a mechanical of a hydraulic mechanism or strips, which are released by use of a slowly dissolving glue or an explosive bolt, or a mechanism triggered by time, pressure or temperature, which are well know techniques to those skilled in the art.

Figure 7:
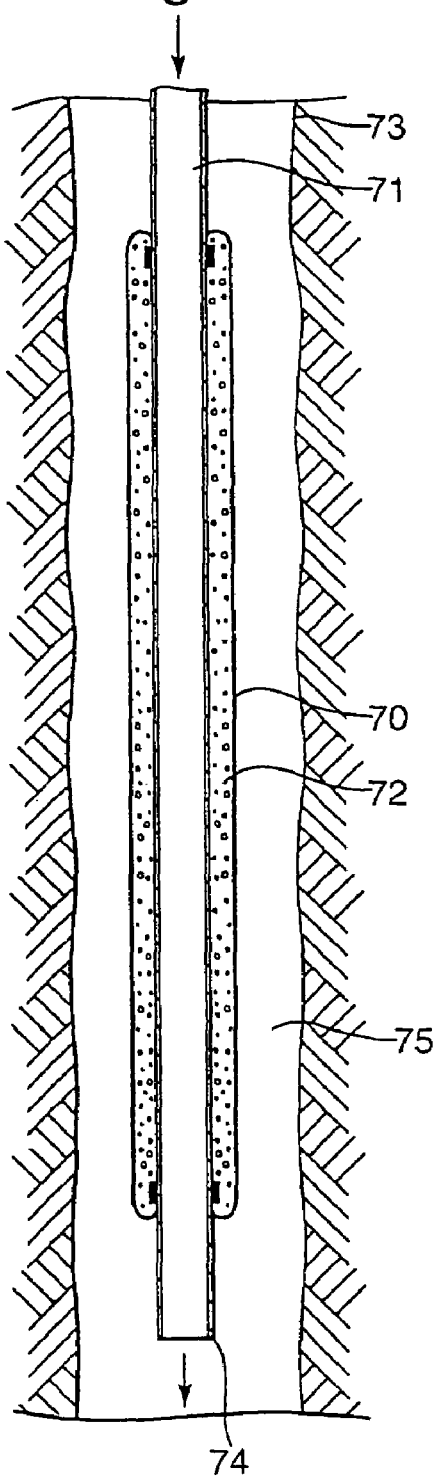
FIG. 7 depicts an expandable screen provided by a permeable bag containing granular material in an annular space between a slurry injection tubing and borehole wall.

FIG. 7 shows a permeable bag 70 which is arranged around a slurry-injection tubing 71 and which is filled with a granular material 72. When the tubing has reached the location in the wellbore 73 where the annular plug is to be set, a fluid slurry is circulated down through the tubing 71 via the lower end 74 of the tubing up into the annulus 75 between the tubing 71 and wellbore 73, such that drag forces exerted by the upward fluid flow in the annulus 75 induce the granular material 72 within the bag 70 to move up, so that the bag is deformed into the droplet shape shown in FIG. 8.

Figure 8:
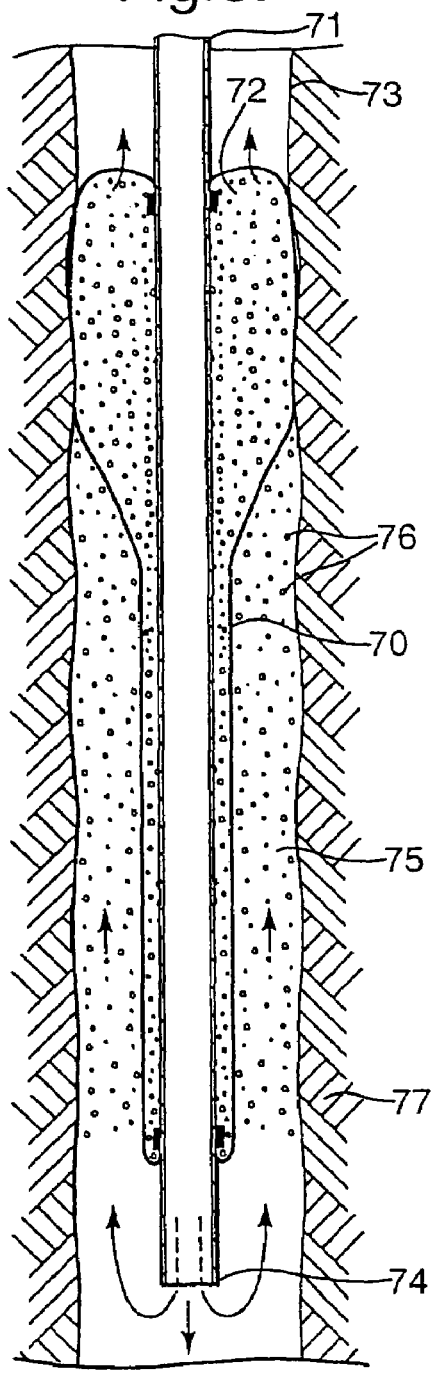
FIG. 8 depicts how the permeable bag is deformed into a droplet shape and provides a permeable zonal isolation in the annulus in response to fluid flow through the annulus.

FIG. 8 shows that the deformed bag provides an annular screen in the annulus 75 between the tubing 71 and wellbore 73 through which fluid may seep, but which blocks granules 76 carried by the fluid such that the deformed bag 70 and annular pack of granules 76 below the bag 70 provide a temporary zonal isolation between the lower and upper parts of the wellbore 73 for as long as fluid flows up through the annulus 75. The deformable bag 70 is therefore particularly suitable for providing a temporary zonal isolation above and also below a target section (not indicated in FIG. 8) of the wellbore 73 in which a chemical treatment fluid such as an acid or caustic fluid is injected at a moderate pressure into the surrounding formation 77.

Figure 9A:
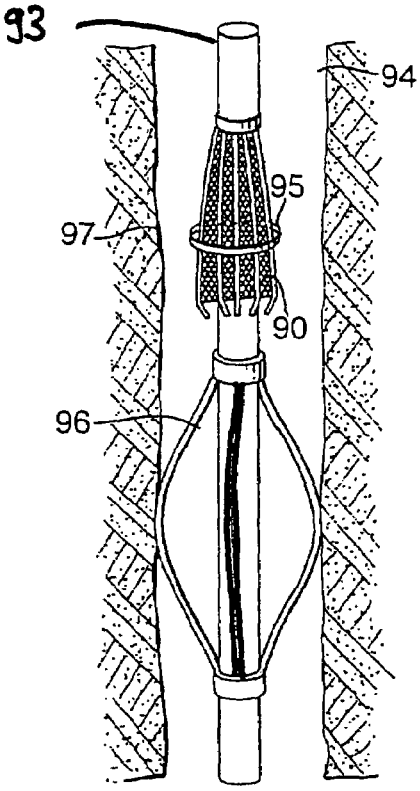
FIG. 9A-C depict a three-dimensional view, a side view and a cross-sectional view of an expandable screen assembly comprising more than twenty spring blades to which a permeable barrier layer is attached.
Figure 9B:
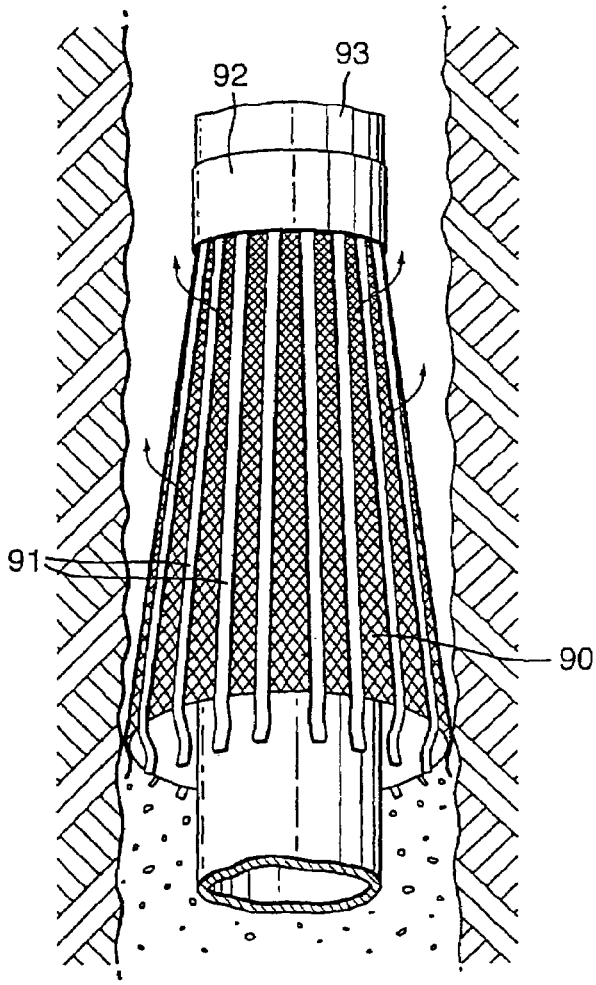
Figure 9C:
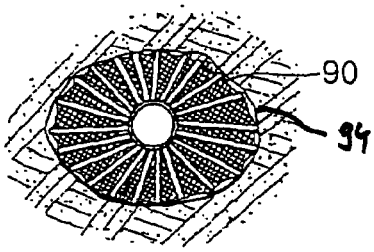

FIG. 9A-C depict an expandable screen 90 which is secured to an expandable carrier frame comprising a series of spring blades 91 that are each at the upper end thereof connected to a carrier ring 92 which is secured to the outer surface of a slurry injection tubing 93.

FIG. 9A shows the unexpanded screen 90 during descent into a wellbore 94. A strip 95 is strapped around the spring blades 91 such that the blades 91 are pulled against the outer surface of the tubing 93. A conventional bow spring centralizer 96 is arranged below the spring blades 91 in order to protect the blades 91 and prevent contact of the blades 91 with the borehole wall 97 during the descent of the tubing 93 into the wellbore 94.

FIG. 9B show that after the tubing 93 is at its target depth and the strip 95 has been released, e.g. by use of a slowly dissolving glue or an explosive bolt, or a mechanism triggered by time, pressure or temperature which are well known to those skilled in the art, the centraliser blades 91 expand against the borehole wall 97, thereby unfolding and expanding the screen 90.

FIG. 9C shows that the screen 90 can be expanded and conform to the oval-shaped borehole wall 97 in an irregular and unround wellbore 94.

Figure 10A:
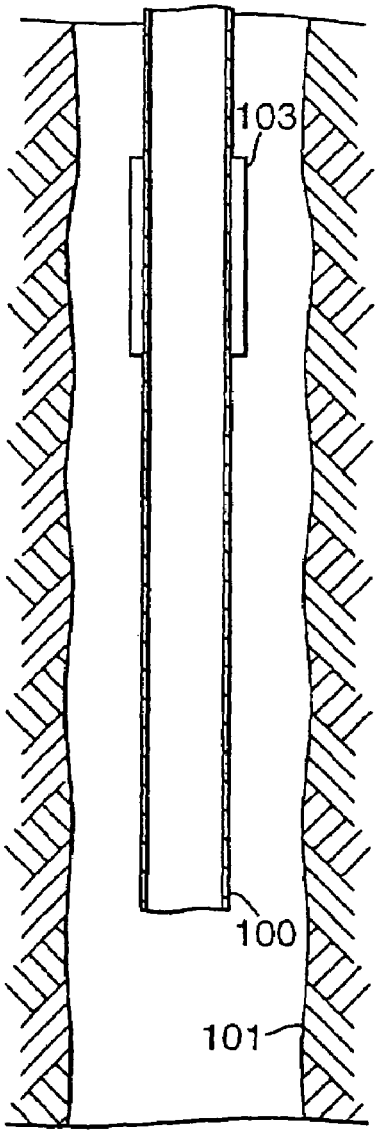
FIGS. 10 A and B depict a screen assembly, which is radially expanded by expansion of the slurry injection tubing.

FIG. 10A shows a slurry-injection tubing 100 which is lowered in an unexpanded configuration into a wellbore 101. A set of bow-spring centralizer blades 103 is secured in a stretched position to the outer surface of the tubing 100, such that the blades can easily descent through narrow or irregular sections of the wellbore 101 with minimal risk that the stabilizer blades 103 or the screen 104 within the blades 103 is damaged during the descent.

Figure 10B:
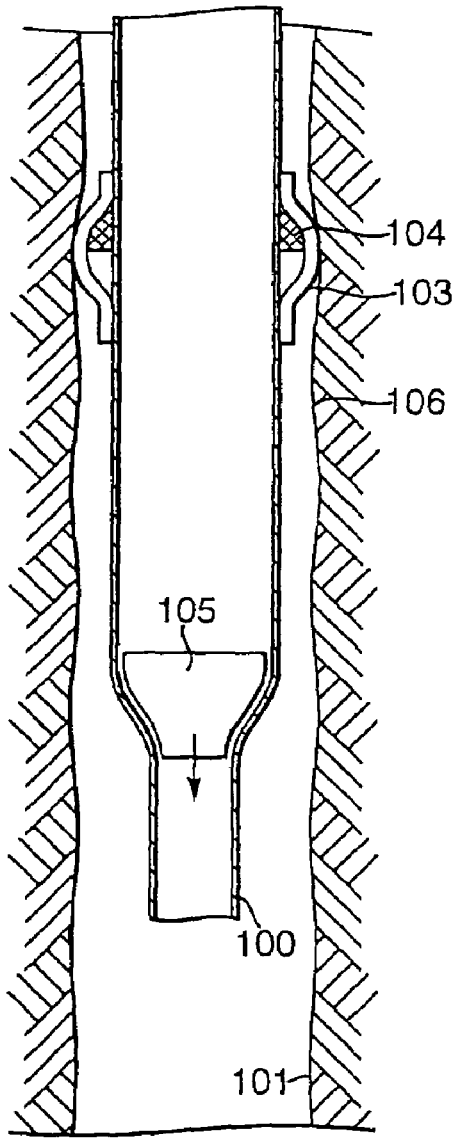

FIG. 10B shows how the slurry injection tubing 100 is radially expanded by pushing an expansion mandrel 105 through the interior of the tubing 100. During the expansion process the tubing 100 is shortened, thereby pushing the ends of the stabilizer blades 103 towards each other. This causes the stabilizer blades 103 to bend into a bow-shaped configuration against the inner surface 106 of the wellbore 101, thereby expanding the screen 104.

Figure 11:
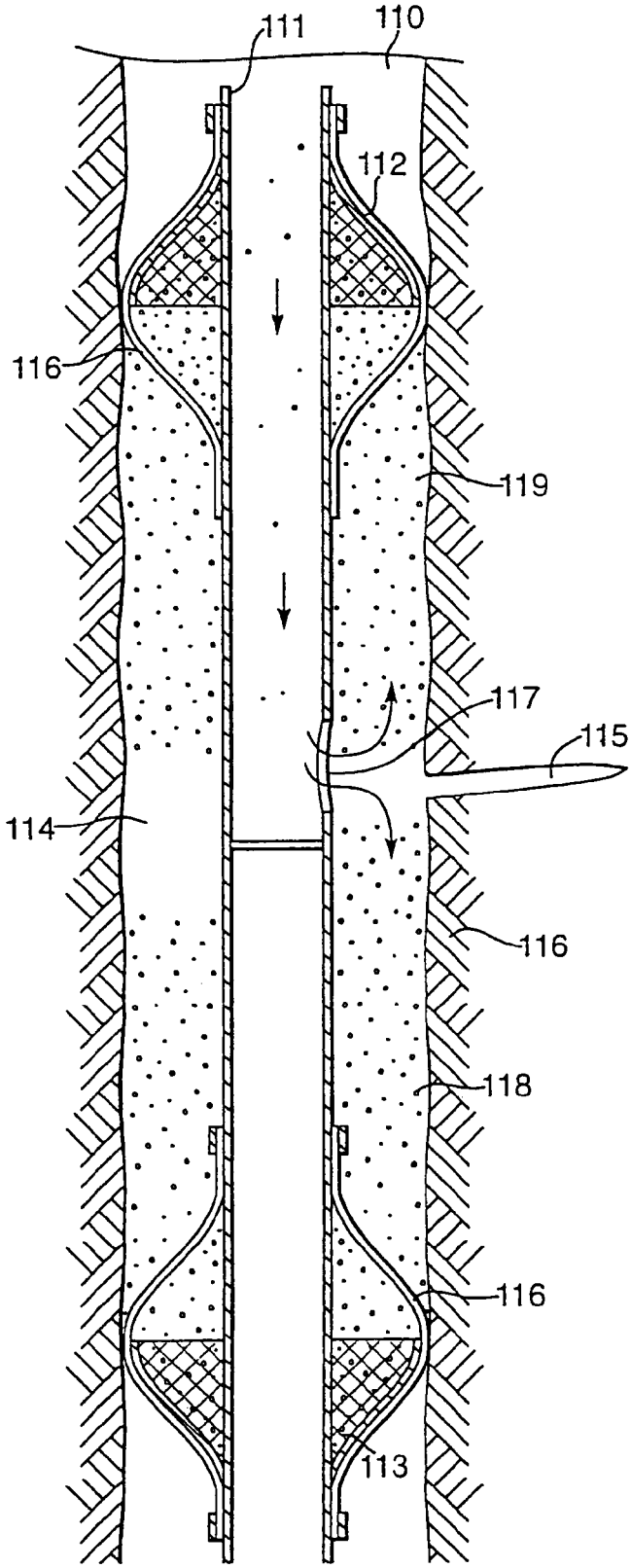
FIG. 11 is a longitudinal sectional view of a wellbore in which granular packers are set both above and below a target zone.

FIG. 11 shows a wellbore 110 in which a slurry-injection tubing 111 is arranged. The tubing 111 carries an upper screen assembly 112 and a lower screen assembly 113 which are arranged above and below a target zone 114 in which a fracture 115 is to be created in the formation 116 or other formation treatment is intended. The screen assemblies 112 and 113 are secured to bow-spring centralizers 116 that are substantially similar to the centralizer assembly shown in FIG. 1.

A slurry comprising a carrier fluid and granules is injected through the slurry injection tubing 111 and an outlet opening 117 into the target zone 114. Some granules 118 may have a higher density than the carrier fluid and drop on top of the lower screen assembly 113 and other granules 119 may have lower density than the carrier fluid and float upwards though the annular space towards the upper screen assembly 113. Alternatively, granulate material may first be circulated at low flow rates to settle on top of the lower screen assembly until a pressure increase inside the slurry-injection tubing indicates that the pack has advanced to the outlet opening 117 where after the flow rate is increased above the slip velocity of the granules so any further granules are induced to settle against the upper screen assembly. When a sufficient amount of granular material has been injected to build annular granular packs of sufficient length, the fluid pressure within the tubing 111 and target zone 114 is raised to such a high level that the fractures 115 are created in the formation 116 surrounding the target zone 114, whereas only moderate pressure is exerted by the packed granules 118 and 119 to the formation 116, so that the risk of fracturing of the formation 116 in the vicinity of the granular packers is minimized.

Figure 12:
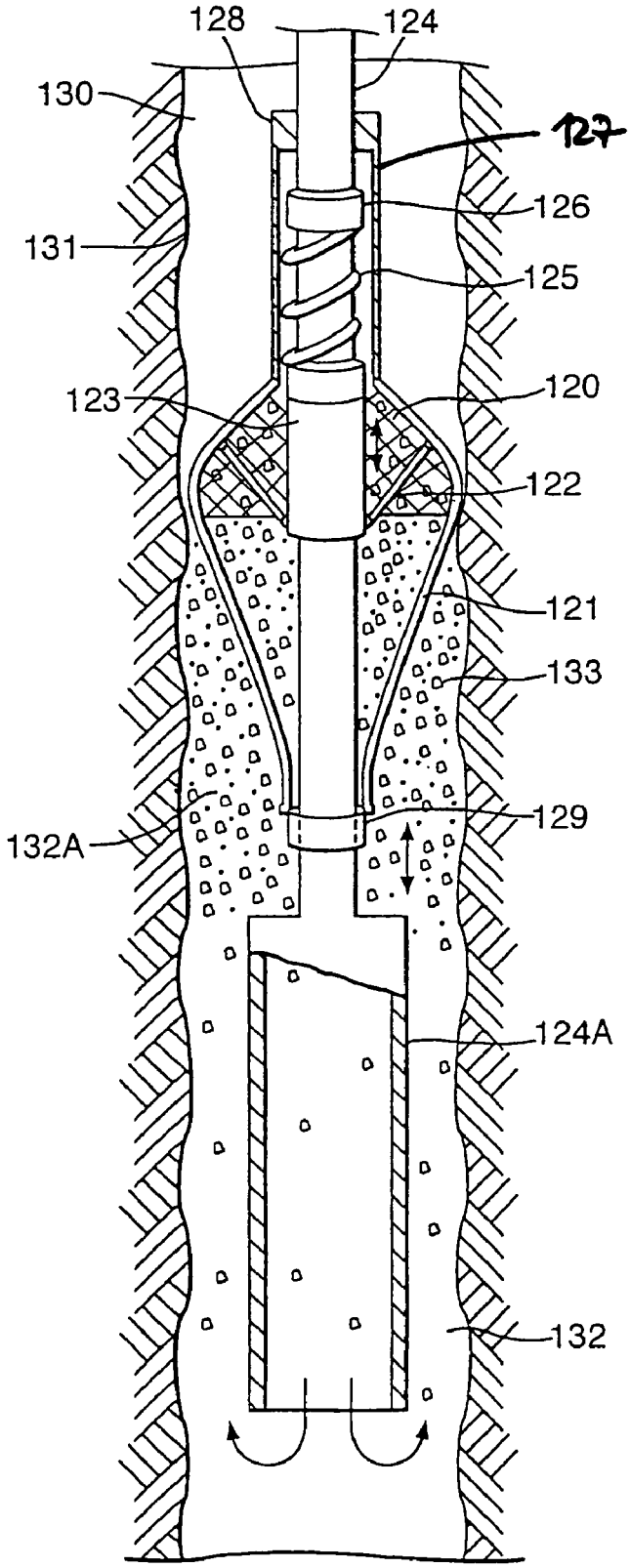
FIG. 12 is a longitudinal sectional view of a spring-enhanced expandable screen assembly, which is mounted on a slurry injection tubing having a lower section with an enlarged diameter.

FIG. 12 shows a screen assembly 120 which is secured to an assembly of bow-spring centralizer blades 121 that are expanded by a series of arms 122, that are at one end pivotally secured to a carrier sleeve 123 and at the other end to the blades 121. The carrier sleeve 123 is slidably arranged around a slurry-injection tubing 124 and pulled up by a pre-stretched spring 125 allowing for a large expansion ratio of the blades 121, which is at its upper end connected to a collar 126 which is secured to the tubing 124. The upper ends of the blades 121 are pivotally secured to a second sleeve 127, which surrounds the carrier sleeve 123, and which is at its upper end connected to the tubing 124 by a stop collar 128. The lower ends of the blades 121 are secured to a sliding collar 129, which is slidably arranged around the tubing 124.

The tubing 124 has a lower section 124A of which the internal and external diameter are larger than those of the other parts of the tubing 124. During descent of the tubing, the sleeve 123 may be pulled down and fixed to the tubing by for example an explosive bolt, such that the arms 122 are parallel to the tubing 124 and the stabilizer blades 121 are stretched. During descent of the tubing 124 into the wellbore 130 the enlarged lower tubing section 124A may inhibit the blades 121 and screen assembly 120 to scratch along the borehole wall 131, which could damage the screen 120. When the lower end 124A of the tubing has reached the target depth the explosive bolt is released, so that the spring 125 pulls the sleeve 123 up, and the arms 122 push the blades 121 against the borehole wall 131. Subsequently slurry is injected down through the tubing 124 and up into the surrounding annulus 132. The increased width of the annulus above the lower tubing section 124A causes a decrease of the upward velocity of the slurry in the region just below the expanded screen 120, which promotes granules 133 to be captured in the widened region of the annular space 132A below the screen 120 and the widened lower section 124A of the tubing 124.

Figure 13:
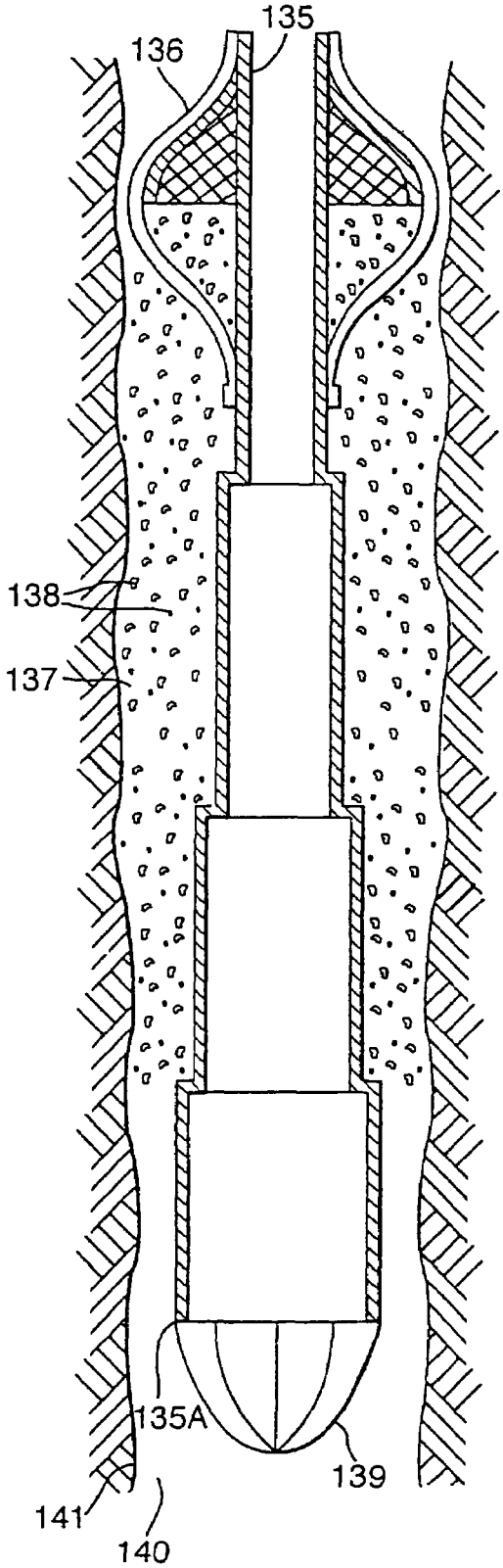
FIG. 13 is a longitudinal sectional view of an expandable screen assembly, which is mounted on a slurry-injection tubing having a lower section with a stepwise enlarged diameter.

FIG. 13 shows an embodiment of a tubing 135, where the internal and external diameter of the tubing 135 are stepwise increased in the region between a expandable screen assembly 136 and a lower end 135A of the tubing. The width of the annulus 137 surrounding the lower portion of the tubing 135 stepwise increases so that the velocity of the slurry reduces and granules 138 easily settle against the expanded screen assembly 136 and the widened lower portions of the tubing 135 prevent granules 138 to fall down through the annulus 137, even if the granules have a higher density than the carrier fluid. The lower end of the tubing 135 is equipped with a nose portion 139 to enable the tubing 135 to slide down easily into the wellbore 140 even if the borehole wall 141 has an irregular shape. The reduction of annular space towards the bottom of the granulate plug and the related increase of flow rate towards the bottom of the granulate plug under constant pump-rate conditions causes the pressure gradient along the pack to increase downwardly along the pack (same for device shown in FIG. 14).

Figure 14:
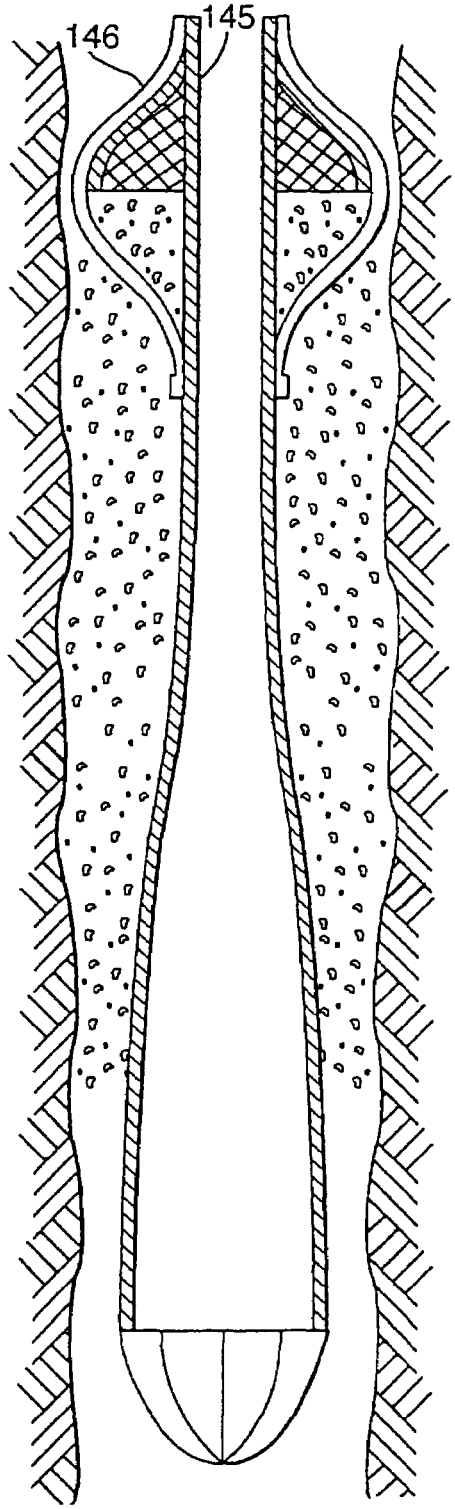
FIG. 14 is a longitudinal sectional view of an expandable screen assembly, which is mounted on a slurry-injection tubing having a lower section with a gradually enlarged diameter.

FIG. 14 shows an embodiment of a slurry-injection tubing 145, wherein the tubing 145 is tapered and has a gradually enlarged diameter in the region below the expandable screen assembly 146.

Figure 15:
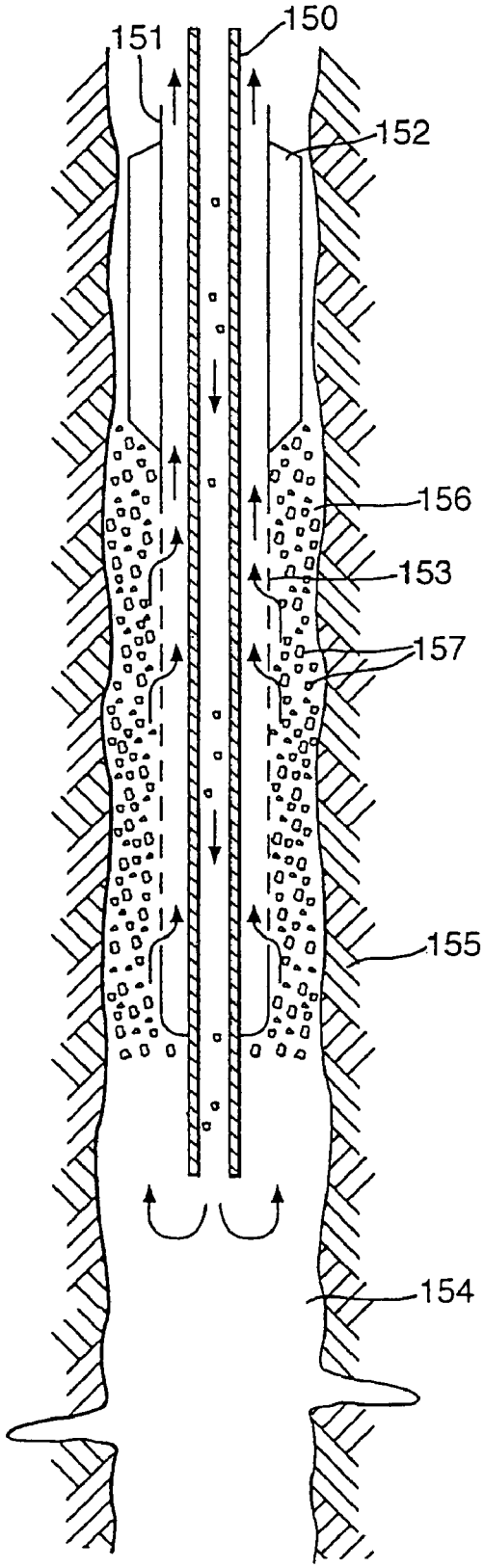
FIG. 15 is a longitudinal sectional view of a permeable screen which is mounted on a co-axial slurry injection tubing and fluid drainage tubing assembly.

FIG. 15 shows an embodiment of a slurry-injection tubing 150, wherein the tubing 150 is surrounded by a fluid return conduit 151. An inflatable packer 152 is mounted above a fluid permeable section 153 of the fluid return conduit 151. The packer 152 is inflated when the lower end of the tubing has reached a target zone 154 where the formation 155 is to be fractured or otherwise treated. The packer 152 may be fluid impermeable or comprise an osmotic membrane, which permits seepage of fluid from the annulus 156 below the packer 152 into the annulus above the packer or into the interior of the fluid return conduit 151.

A slurry comprising a carrier fluid, such as water, foam and a granular material 157 is then injected via the slurry injection tubing 150 and the target zone 154 into the annulus 156. The granular material 157 is trapped in the annulus 156, but the carrier fluid seeps through the packed granular material 157 and the permeable section 153 of the fluid return conduit 151. The flux of carrier fluid into the fluid return conduit 151 can be controlled by monitoring and controlling the fluid pressure in the fluid return conduit 151. The controlled leakage of carrier or other fluid into the fluid return conduit 151 may be used to control the pressure gradient along the length of the granular packer in the annulus 156.

Figure 16:
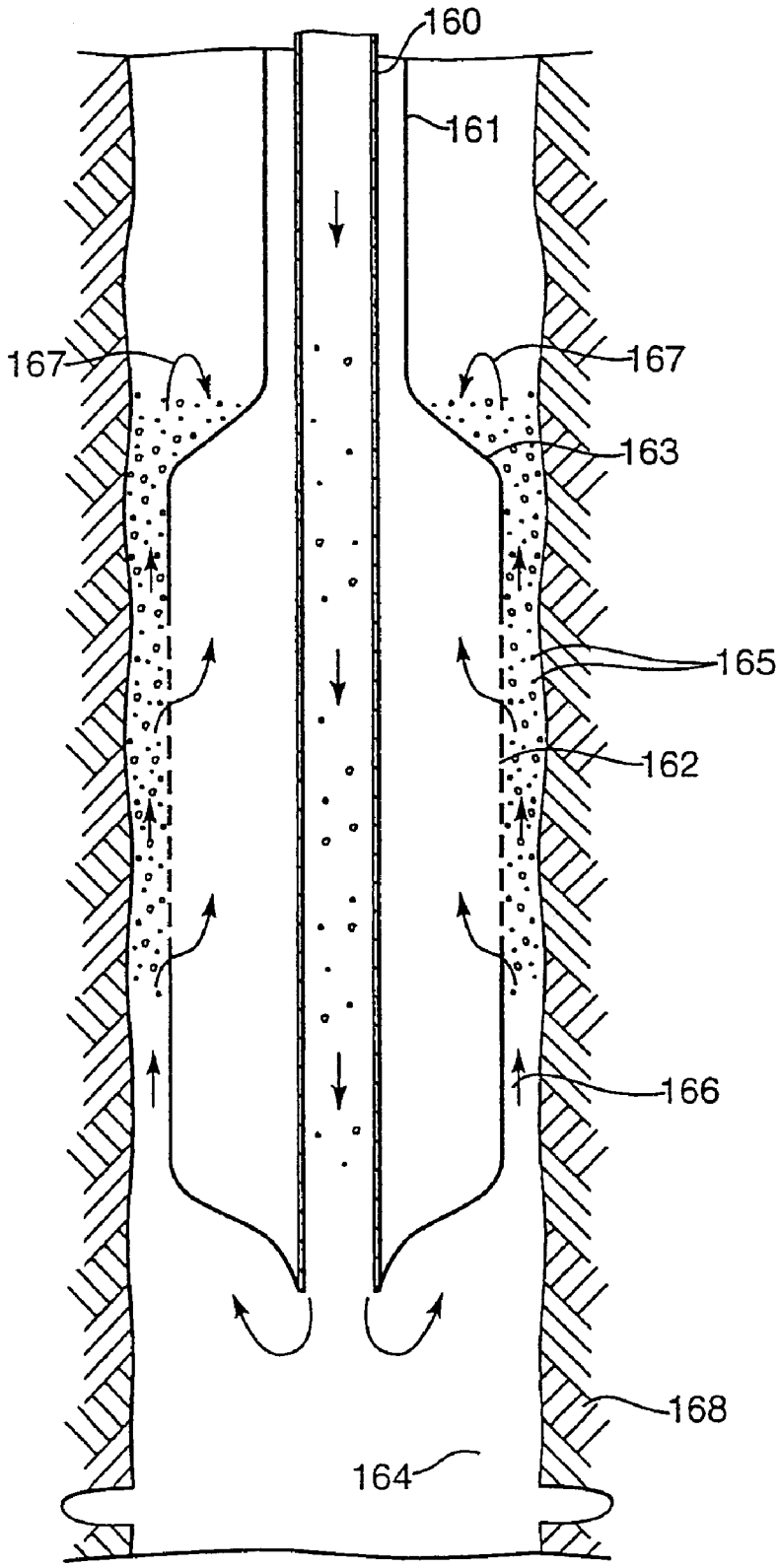
FIG. 16 is a longitudinal sectional view of a co-axial slurry injection tubing and fluid drainage tubing assembly, where the slurry velocity is lowered to below the slip velocity such that granular material settles in the surrounding annulus.

FIG. 16 shows an embodiment of a slurry-injection tubing 160, wherein the tubing 160 is surrounded by a fluid return conduit 161. The fluid return conduit 161 comprises a widened lower section 162 having a fluid permeable wall and a frusto-conical intermediate section 163, which connects the lower section 162 to the upper portion of the fluid return conduit 161.

When the lower end of the slurry injection tubing 160 has reached the target zone 164 a slurry comprising carrier fluid and granular material 165 having a density which is higher than the density of the carrier fluid is injected via the tubing 160 and the target zone 164 into the annulus 166 surrounding the widened lower section 162 of the fluid return conduit 161.

The frusto-conical intermediate section 163 will act as a particle accumulation means, which serves to modify the slurry flow by reducing the slurry velocity in the annulus 166 to a value below the slip velocity of the granular material 165. This will cause granular material to settle on top of the frusto-conical section 163 and fall back into the annulus 166 as illustrated by arrows 167. The settled granular material will form an arch in the annulus 166 between the widened lower section 162 of the fluid return conduit and the surrounding formation 168. This arch of granular material 165 will form a fluid permeable barrier near the frusto-conical section 163 against which other granular material will settle until the annulus 166 is completely filled with granular material 165. As the permeability along the annulus is strongly reduced once the annular pack is established, the amount of carrier fluid seeping into the fluid-return conduit through the fluid-permeable outer wall increases, thereby the flow rate decreases in the annulus and the pump rate can be increased without flushing away the granulate material from the top of the plug. In this embodiment, the fluid that seeped out of the annular space into the fluid-return conduit is released (not shown) into the annulus above the particle accumulation means.

Figure 17:
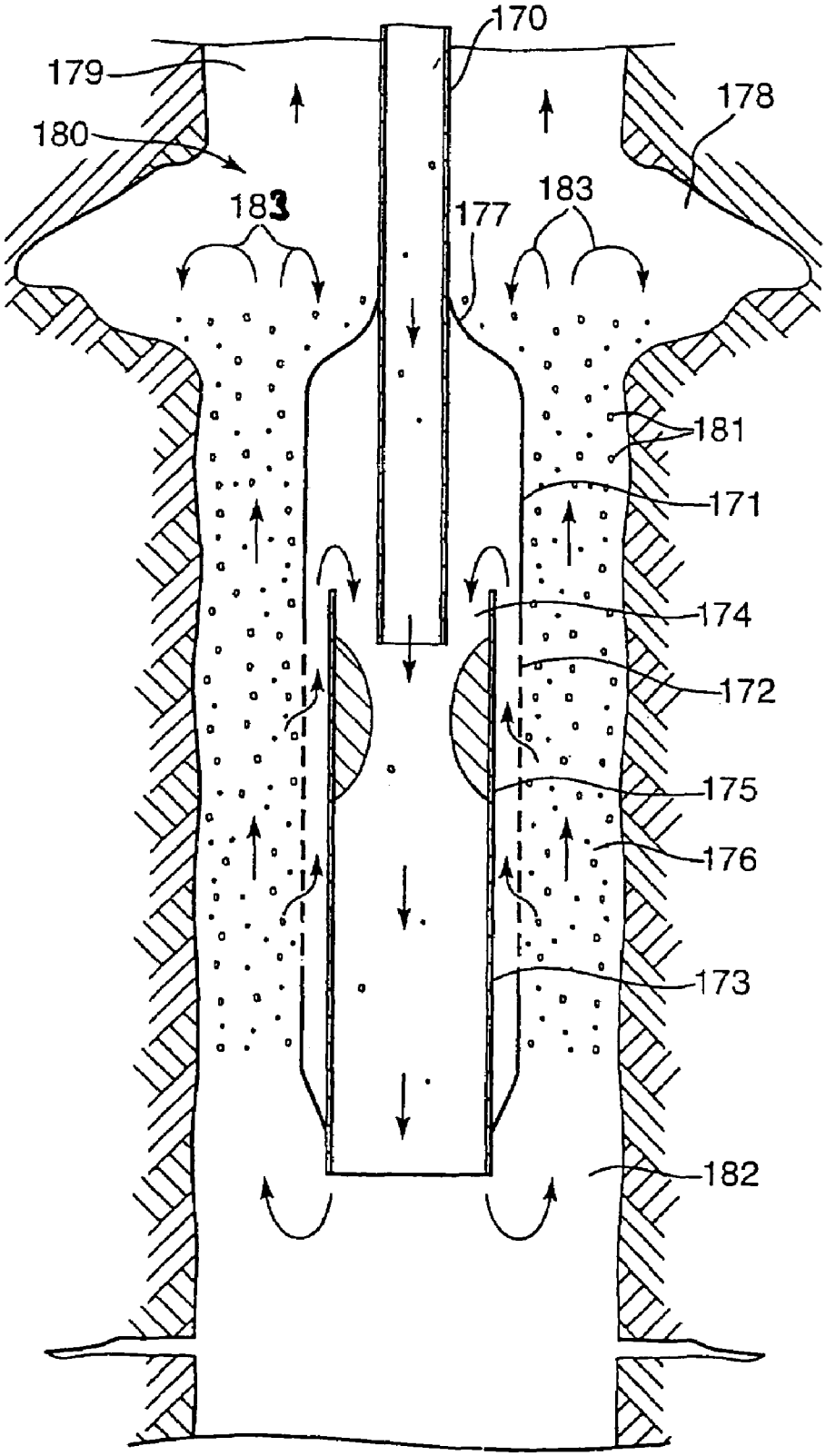
FIG. 17 is a longitudinal sectional view of a co-axial slurry injection tubing and fluid drainage tubing assembly, where the slurry velocity is lowered to below the slip velocity near a washout zone such that granular material settles in the washout zone, and where the fluid entering the drainage pipe is re-injected downwardly via a jet-pump assembly.

FIG. 17 shows yet another embodiment of a slurry-injection tubing 170, wherein a lower portion of the tubing is surrounded by a fluid re-circulation conduit 171. The re-circulation conduit 171 has a permeable section 172, which is arranged around a shielding conduit 173, of which the upper end co-axially surrounds the tubing 170, such that in the annular space 174 between the tubing 170 and the conduit 173 a fluid jet pump is created such that if slurry is pumped down through the tubing 170 the fluid pressure in the annular space 175 between the shielding conduit 173 and the re-circulation conduit 172 is reduced and fluid is sucked from the annulus 176 into said space 175 and then into the interior of the shielding conduit 173.

A frusto-conical portion 177 at the upper end of the fluid re-circulation conduit 171 may be located adjacent to a wash-out zone 178 where the wellbore 179 has an enlarged width, such that the upward velocity of the slurry is reduced significantly, when it flows from the narrow annulus 176 into the widened annulus 180 formed between the frusto-conical portion 177 and the wash-out zone 178.

When a slurry comprising carrier fluid and granules 181 is injected via the interior of the slurry injection tubing 170 into a target zone up into the annulus 176 then the drainage of carrier fluid into the recirculation conduit 172 and the further reduction of fluid velocity in the widening annulus 180 causes granules 181 to drop down in the annulus 180 as illustrated by arrows 183. The thus settled granules 181 will form a barrier against which other granules 181 will accumulate until the annulus 176 is filled with granules 181. The granules 181 will provide a granular packer in the annulus 176 wherein the pressure drop along the length of the annulus 176 is controlled by the re-circulation of carrier fluid through the permeable wall of the re-circulation conduit 172. The absence of a fragile expandable screen assembly makes the configuration shown in FIG. 17 particularly suitable for use in irregular wellbores with large wash-out zones 178. As compared to the embodiment shown in FIG. 16, this version has the advantage of enabling a larger change in annular space (even without a washout zone present) for a given diameter of fluid-injection conduit 170 and a more effective drainage of the granulate pack owing to the effect of the jet-pump assembly. When the method of the present invention is being used to prepare a zonal isolation for fracturing around the target zone, pumping of the slurry can be continued after a sufficiently impermeable zonal isolation is formed. At further pumping the pressure in the target zone of the wellbore increases rapidly to values that cause fracturing of the surrounding formation. In a particular embodiment of the method of the present invention, in a first step an auxiliary material is first accumulated at the desired position in the annulus to form a permeable barrier against which the granular material can subsequently be accumulated. A suitable auxiliary material is flexible foam, in particular open cell foam. Open cell foam has connected pores, and therefore some permeability, and it can deform with minimal resistance. Flexible polyurethane foam is an example, optionally including additives for temperature stability, stiffness, or other physical properties. Other auxiliary materials could for example be swellable or liquid-deformable rubbers.

Such foam can be used to form a liquid permeable barrier in the annular space behind which the granular material can accumulate. For example, pieces or lumps of foam can be passed into the annular space to accumulate at the desired position, in connection with one of the embodiments discussed with reference to FIGS. 1-17. For example, an expandable screen can have a maze size such that foam pieces are accumulated there. When subsequently the slurry comprising the granular material is introduced into the annulus, a filter cake will form on the upstream side of the foam. This creates a higher pressure drop across the bed of foam lumps in the direction along the axis of the well. The foam is then compressed along the axis of the well and is deformed in a radial direction. The deformation of the foam cells causes the permeability to decrease dramatically and these effects cause the bed of foam lumps to form a plug across the diameter of the well which acts as a very effective basis for the pack of granular material to form against. The foam can thus serve to initiate accumulation of the granular material.

Alternatively, a foam plug can also be pre-mounted on the injection tubing or against a suitable fixation member or screen on the tubing. The foam can initially be mounted in a radially compressed manner, and can when desired be expand against the borehole wall in a suitable way. Suitable material is known from foam pigs used for pipeline cleaning. In a further embodiment of the method of the present invention, the wetting properties of the liquid present in the accumulated granular material can be modified. Surface tension forces of interparticle liquid can for example be modified by surfactants. If the surface tension forces between the particles of the pack and the interparticle fluid are increased, the volume of immobile connate fluid is increased, and the leakage rate along the pack is decreased for a given pressure difference. Conversly, if the surface tension forces between the particles of the pack and the interpartical fluid are decreased, the volume of immobile connate fluid is decreased, and the leakage rate along the pack is increased for a given pressure difference. Additionally the pack may be easier to remove by mechanical and/or circulation.

The surface tension forces may be controlled in several ways, including the use of surfactants. These surfactants may be introduced in to the pack in several ways, for example they can be comprised in the carrier fluid or coated onto the granular material forming the slurry, they can be coated onto the workstring used to circulate the particles, or they can be comprised in a fluid which is pumped through the matrix of accumulated material after it has been positioned.

The surfactants may be used to increase or decrease the surface tension forces. The same or different surfactants may be used in sequence. For example, one surfactant can be used to raise the surface tension forces. In this way the leakage through the pack for a given pressure drop along the pack can be decreased. Another surfactant can later be used to lower the surface tension again. Thus, by lowering adhesive/cohesive forces within the pack, the pack is made easier to remove, e.g. by circulation, workstring movement, or other mechanical means.

In a practically important embodiment the granular material is physically accumulated by removing carrier fluid, but does not undergo a chemical reaction such as setting (e.g. of cement). It can also be preferred that the granules do not change their shape, e.g. due to swelling, so in this case it would not be desired to use a swellable clay such as bentonite. An advantage of these embodiments is that the zonal isolation can relatively easily be removed again. If the zonal isolation in such an embodiment is merely formed of accumulated solids without strong physico/chemical interaction or bonding, it shall be clear that it may be needed to maintain a pressure from below in order to keep the zonal isolation in place.

In other applications of the method it can be desired to set a plug of cement and/or bentonite, wherein particular use is made of the property of the particle accumulation means to remove liquid from the slurry. In one option a dilute cement slurry can be pumped down the well in a weak slurry with an inhibitor in the carrier fluid. The cement then packs off against the particle accumulation means such as a screen in the annulus, the carrier fluid is squeezed through and replaced with water with no inhibitor. The cement then sets rapidly.

Normally a cement slurry is an aqueous slurry. In another option the cement can be pumped suspended in diesel oil or other hydrocarbon. The cement packs off against the screen or restrictor, and the diesel oil flows through, followed by water. The concentrated cement mass then sets rapidly in the water.

Instead of or in addition to cement also a swellable clay such as bentonite can be used, which will swell when it comes into contact with water.

Figure 18:
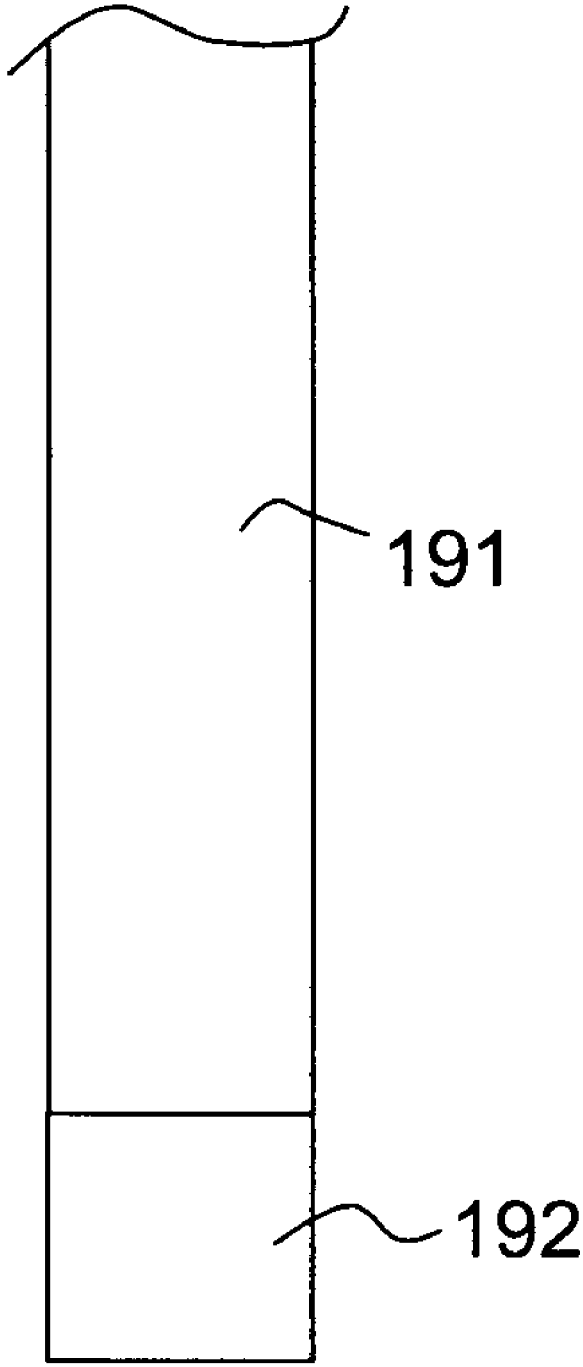
FIG. 18 schematically shows a slurry injection tubing provided by a drill string.

The slurry injection tubing can be provided by a drill string. FIG. 18 shows labeled representations of a drill string 191 and a drill bit 192.

The invention claimed is:

1. A method of creating a zonal isolation adjacent to a target zone in an underground wellbore, the method comprising:

inserting a slurry injection tubing through a wellhead into the wellbore;

arranging a particle accumulation means in an annular space surrounding the slurry injection tubing at a location between the target zone and the wellhead; and pumping a slurry comprising a carrier fluid and granular material via the slurry injection tubing into the annular space, such that at least some granular material accumulates adjacent to the particle accumulation means and the accumulated granular material forms a zonal isolation comprising packed granular material adjacent to the particle accumulation means;

wherein the particle accumulation means comprises a means for removing liquid from the slurry, selected from the group consisting of a fluid permeable barrier in the annular space and a fluid return conduit surrounding the slurry injection tubing; wherein during pumping of the slurry at least part of the carrier fluid is removed from the slurry and wherein the granular material is induced to accumulate in a region of the annular space which is located between the target zone and the particle accumulation means, such that the particle accumulation means is arranged between the accumulated granular material and the wellhead.

2. The method of claim 1, wherein the fluid slurry comprises granular material of which the grain size is stepwise or gradually reduced during the injection process thereby inducing an initial batch of coarse granular material to settle and accumulate and subsequent batches of less coarse granular material to settle and accumulate against the annular matrix of coarser granular material.

3. The method of claim 1, wherein before pumping of the slurry into the annular space an auxiliary material is arranged in the annular space, forming a fluid permeable barrier.

4. The method of claim 3, wherein the auxiliary material comprises a solid foam.

5. The method of claim 1, wherein the fluid slurry comprises particles from a swellable material, and a carrier fluid in which the swellable material does not swell, and wherein after accumulation of the swellable particles a swelling fluid is passed through the accumulated particles thereby allowing the particles to swell.

6. The method of claim 1, wherein the granular material is selected from a group consisting of a swellable rubber, resin coated gravel, sand, a natural or artificial proppant, glass, plastic or other beads, hollow beads, beads and/or balls that are coated with glue, resin or fibers, steel or magnetisable metals, fibers, and/or fibers with hooks, and mixture(s) thereof.

7. The method of claim 1, wherein the granular material comprises a material and/or coating which dissolves at an elevated temperature or in a specific fluid.

8. The method of claim 7, wherein the specific fluid is an acidic fluid.

9. The method of claim 7, wherein the specific fluid is a caustic fluid.

10. The method of claim 1, wherein after installation of the zonal isolation in the annulus surrounding the slurry injection tubing a fracturing, stimulation, treatment, formation etching, disposal or other fluid is injected via the slurry injection tubing into the target zone and optionally into the formation surrounding the target zone.

11. The method of claim 10, wherein the outer surface of the slurry injection tubing is provided with a helical ridge and after completion of the fluid injection into the formation via the target zone the slurry injection tubing is rotated such that the helical ridge induces the tubing to move upwardly through the matrix of granular material towards the wellhead.

12. The method of claim 10, wherein the slurry injection tubing comprises a pair of axially spaced expandable screen assemblies and is inserted into the wellbore such that the target zone is located between said assemblies and wherein slurry is injected via an outlet opening in the wall of the tubing into the region of the annular space between the screen assemblies such that at least some granular material accumulates against each screen assembly and a zonal isolation is created at both sides of the target zone.

13. The method of claim 2, wherein the wellbore forms part of a well selected from the group consisting of an oil well, a gas production well, a geothermal well, a water well, a disposal well, and combination(s) thereof.

14. A method of creating a zonal isolation adjacent to a target zone in an underground wellbore, the method comprising:

inserting a slurry injection tubing through a wellhead into the wellbore;

arranging a particle accumulation means in an annular space surrounding the slurry injection tubing at a location between the target zone and the wellhead; and pumping a slurry comprising a carrier fluid and granular material via the slurry injection tubing into the annular space, such that at least some granular material accumulates adjacent to the particle accumulation means and the accumulated granular material forms a zonal isolation comprising packed granular material adjacent to the particle accumulation means;

wherein the particle accumulation means comprises an expandable screen assembly which is permeable to the carrier fluid, but impermeable to at least some of the granular material; and the method further comprises:

radially expanding the screen assembly within the annular space; and inducing the fluid slurry to flow in longitudinal direction through the annular space such that at least some carrier fluid is induced to flow through the expanded screen assembly and at least some granular material is induced to settle and accumulate against the expanded screen assembly, thereby forming a zonal isolation comprising a matrix of packed granular material in the annular space between the target zone and the expanded screen assembly.

15. The method of claim 14, wherein the expandable screen assembly comprises a radially expandable carrier frame and a permeable barrier layer.

16. The method of claim 15, wherein the radially expandable carrier frame comprises an expandable umbrella-shaped frame, which comprises at least three arms that are each at one end pivotally connected to the outer surface of the slurry injection tubing such that another portion of each arm is induced to swing against the inner surface of the wellbore or well casing in response to expansion of the umbrella-shaped frame.

17. The method of claim 15, wherein the expandable carrier frame comprises a bow-spring centralizer assembly having at least three centralizer blades, which expand against the borehole wall at circumferentially spaced locations.

18. The method of claim 17, wherein at least one centralizer blade is configured to expand against the inner surface of the surrounding wellbore or well casing independently from other centralizer blades, such that the blades each expand against said inner surface even if the surface has an irregular, unround or elliptical inner shape.

19. The method of claim 18, wherein the assembly of bow spring centralizer blades comprises a set of short and a set of long centralizer blades, that are each at one end thereof secured to a first end ring which is secured to the outer wall of the fluid injection tubing and wherein the ends of the short centraliser blades are secured to a second end ring which is slidably arranged around the fluid injection tubing and the ends of the long centralizer blades are secured to a third end ring which is slidably arranged around the outer wall of the fluid injection tubing.

20. The method of claim 18, wherein the assembly of bow spring centralizer blades comprises a set of short and a set of long centralizer blades and the ends of the long centralizer blades are secured to end rings which are slidably arranged around the fluid injection tubing at different sides of a stop collar which is secured to the outer surface of the tubing, and wherein the ends of the short centralizer blades are secured to end rings which are slidably arranged around the fluid injection tubing and which are each located between the stop collar and one of the end rings of the long centralizer blades.

21. The method of claim 17, wherein the ends of the centralizer blades are connected at axially spaced locations to the outer surface of a radially expandable slurry injection tubing, such that the centralizer blades are arranged in a substantially stretched position around the tubing before expansion of the tubing and that the distance between the ends of the stabilizer blades is decreased as a result of the axial shortening of the tubing during the expansion process, whereby the centralizer blades are induced to radially expand within the annulus surrounding the fluid injection tubing.

22. The method of claim 17, wherein a skirt shaped barrier layer is arranged around the slurry injection tubing and secured to an upper section of the centralizer blades such that the skirt shaped barrier layer substantially spans the width of the annular space in response to expansion of the centralizer blades.

23. The method of claim 15, wherein the permeable barrier layer of the screen assembly is established and/or enhanced by pumping into the annular space a fluid slurry comprising fibrous material which is induced to settle against the expanded screen assembly prior to or simultaneously with the granular material.

24. The method of claim 14, wherein the expandable screen assembly comprises a woven pattern of helically coiled fibers, which fibers are secured between a pair of rings that are arranged around the outer surface of the fluid injection tubing and which are moved towards each other such that the helically coiled fibers deform and are at least partly expanded against the inner surface of the wellbore.

25. The method of claim 14, wherein the expandable screen assembly comprises a permeable sack, which is filled with granular material, and which is induced to expand against the inner surface of the wellbore in response to flux of the fluid slurry flowing up through the annular space between the slurry injection tubing and the wellbore.

26. A method of creating a zonal isolation adjacent to a target zone in an underground wellbore, the method comprising:

inserting a slurry injection tubing through a wellhead into the wellbore;

arranging a particle accumulation means in an annular space surrounding the slurry injection tubing at a location between the target zone and the wellhead; and pumping a slurry comprising a carrier fluid and granular material via the slurry injection tubing into the annular space, such that at least some granular material accumulates adjacent to the particle accumulation means and the accumulated granular material forms a zonal isolation comprising packed granular material adjacent to the particle accumulation means;

wherein the slurry injection tubing is radially expanded after inserting a matrix of packed granular material in the annulus between the slurry injection tubing and the wellbore, thereby increasing the packing density and decreasing the permeability of the matrix of packed granular material.

27. A method of creating a zonal isolation adjacent to a target zone in an underground wellbore, the method comprising:

inserting a slurry injection tubing through a wellhead into the wellbore;

arranging a particle accumulation means in an annular space surrounding the slurry injection tubing at a location between the target zone and the wellhead; and pumping a slurry comprising a carrier fluid and granular material via the slurry injection tubing into the annular space, such that at least some granular material accumulates adjacent to the particle accumulation means and the accumulated granular material forms a zonal isolation comprising packed granular material adjacent to the particle accumulation means;

wherein the particle accumulation means is provided by a region of the annular space, in which the fluid velocity is reduced and granular material is induced to settle by an increased cross-section of the annular space with respect to an upstream region thereof with regard to slurry flow.

28. The method of claim 27, wherein the region of the annular space in which the fluid velocity is reduced is formed by a washout zone in which the wellbore has a larger width than other parts of the wellbore and/or by a region where the slurry injection tubing or a fluid return conduit surrounding the slurry injection tubing is inwardly tapered or otherwise reduced in outer diameter.

29. A method of creating a zonal isolation adjacent to a target zone in an underground wellbore, the method comprising:

inserting a slurry injection tubing through a wellhead into the wellbore;

arranging a particle accumulation means in an annular space surrounding the slurry injection tubing at a location between the target zone and the wellhead; and pumping a slurry comprising a carrier fluid and granular material via the slurry injection tubing into the annular space, such that at least some granular material accumulates adjacent to the particle accumulation means and the accumulated granular material forms a zonal isolation comprising packed granular material adjacent to the particle accumulation means;

wherein the particle accumulation means comprises a means for removing liquid from the slurry, selected from the group consisting of a fluid permeable barrier in the annular space and a fluid return conduit surrounding the slurry injection tubing; wherein during pumping of the slurry at least part of the carrier fluid is removed from the slurry; and wherein the particle accumulation means comprises a fluid return conduit surrounding the slurry injection tubing, which fluid return conduit has a permeable outer wall, and wherein at least some fluid is induced to flow from the annular space into the fluid return conduit.

30. A method of creating a zonal isolation adjacent to a target zone in an underground wellbore, the method comprising:

inserting a slurry injection tubing through a wellhead into the wellbore;

arranging a particle accumulation means in an annular space surrounding the slurry injection tubing at a location between the target zone and the wellhead; and pumping a slurry comprising a carrier fluid and granular material via the slurry injection tubing into the annular space, such that at least some granular material accumulates adjacent to the particle accumulation means and the accumulated granular material forms a zonal isolation comprising packed granular material adjacent to the particle accumulation means;

wherein the particle accumulation means comprises a means for removing liquid from the slurry, selected from the group consisting of a fluid permeable barrier in the annular space and a fluid return conduit surrounding the slurry injection tubing; wherein during pumping of the slurry at least part of the carrier fluid is removed from the slurry; and wherein the slurry injection tubing is inwardly tapered or has a stepwise reduced inner and outer diameter in the region between the target zone and the expandable screen assembly, such that the velocity of the slurry in the annular space is reduced when the slurry flows from the target zone towards the screen assembly.

31. A method of creating a zonal isolation adjacent to a target zone in an underground wellbore, the method comprising:

inserting a slurry injection tubing through a wellhead into the wellbore;

arranging a particle accumulation means in an annular space surrounding the slurry injection tubing at a location between the target zone and the wellhead; and pumping a slurry comprising a carrier fluid and granular material via the slurry injection tubing into the annular space, such that at least some granular material accumulates adjacent to the particle accumulation means and the accumulated granular material forms a zonal isolation comprising packed granular material adjacent to the particle accumulation means;

wherein the fluid slurry comprises a cement slurry from which the carrier fluid is removed during accumulation.

32. The method of claim 31, wherein the carrier fluid is selected such that cement does not set in the carrier fluid, and wherein after accumulation of cement particles in the annular space a setting fluid, preferably comprising water, is passed through the accumulated cement particles thereby allowing the cement to set.

33. A method of creating a zonal isolation adjacent to a target zone in an underground wellbore, the method comprising:

inserting a slurry injection tubing through a wellhead into the wellbore;

arranging a particle accumulation means in an annular space surrounding the slurry injection tubing at a location between the target zone and the wellhead; and pumping a slurry comprising a carrier fluid and granular material via the slurry injection tubing into the annular space, such that at least some granular material accumulates adjacent to the particle accumulation means and the accumulated granular material forms a zonal isolation comprising packed granular material adjacent to the particle accumulation means;

wherein the particle accumulation means is provided with magnets and the granular material comprises magnetisable components.

34. A method of creating a zonal isolation adjacent to a target zone in an underground wellbore, the method comprising:

inserting a slurry injection tubing through a wellhead into the wellbore;

arranging a particle accumulation means in an annular space surrounding the slurry injection tubing at a location between the target zone and the wellhead; and pumping a slurry comprising a carrier fluid and granular material via the slurry injection tubing into the annular space, such that at least some granular material accumulates adjacent to the particle accumulation means and the accumulated granular material forms a zonal isolation comprising packed granular material adjacent to the particle accumulation means;

wherein the particle accumulation means comprises a means for removing liquid from the slurry, selected from the group consisting of a fluid permeable barrier in the annular space and a fluid return conduit surrounding the slurry injection tubing; wherein during pumping of the slurry at least part of the carrier fluid is removed from the slurry; and wherein the zonal isolation of accumulated granular material is configured such that it has a higher longitudinal permeability than at least a substantial part of the formation surrounding the target section of the wellbore.

35. The method of claim 34, wherein a fracturing and/or stimulation fluid is injected into the formation surrounding the target section of the wellbore and the matrix of granular material has a substantially annular shape and a longitudinal permeability such that during the step of injecting fracturing fluid into the formation fracturing fluid leaks through the matrix of granular material and the change of static pressure in the wellbore fluid over the matrix of granular material is larger than the change of a characteristic formation pressure, such as the fracture-initiation, fracture-propagation or formation-breakdown pressure over the same section in the formation surrounding the matrix.

* * * * *